United States Patent [19]

Harada

[11] Patent Number: 4,709,788

[45] Date of Patent: Dec. 1, 1987

[54] GROUP CONTROL APPARATUS FOR ELEVATORS

[75] Inventor: Yutaka Harada, Tokyo, Japan

[73] Assignee: Kabushiki Kaisha Toshiba, Kawasaki, Japan

[21] Appl. No.: 875,876

[22] Filed: Jun. 18, 1986

[30] Foreign Application Priority Data

Jun. 28, 1985 [JP] Japan ..... 60-142156

[51] Int. Cl.[4] ..... B66B 1/18

[52] U.S. Cl. ..... 187/124

[58] Field of Search ..... 187/29, 101, 124, 130

[56] References Cited

U.S. PATENT DOCUMENTS

| | | | |
|---|---|---|---|
| 3,782,504 | 1/1974 | Billmaier et al. | 187/29 R |
| 3,804,209 | 4/1974 | Edison | 187/29 R |
| 3,841,443 | 10/1974 | Booker, Jr. | 187/29 R |
| 3,851,735 | 12/1974 | Winkler et al. | 187/29 R |
| 4,346,789 | 8/1982 | Ekholm | 187/29 R |
| 4,431,085 | 2/1984 | MacDonald | 187/29 R |
| 4,497,391 | 2/1985 | Mendelsohn et al. | 187/29 R |

FOREIGN PATENT DOCUMENTS

| | | |
|---|---|---|
| 55-48173 | 4/1980 | Japan . |
| 57-1174 | 1/1982 | Japan . |

*Primary Examiner*—William M. Shoop, Jr.
*Assistant Examiner*—W. E. Duncanson, Jr.
*Attorney, Agent, or Firm*—Oblon, Fisher, Spivak, McClelland & Maier

[57] ABSTRACT

A group control apparatus for elevators includes a main station for performing a hall call registration of an elevator cage, floor remote stations, arranged in elevator halls for the respective floors of a building in which elevators are installed, for generating a hall call signal and performing a call display of the elevator cage, and a single data transmission line for coupling each of the floor remote stations to the main station and for performing serial data transmission.

12 Claims, 13 Drawing Figures

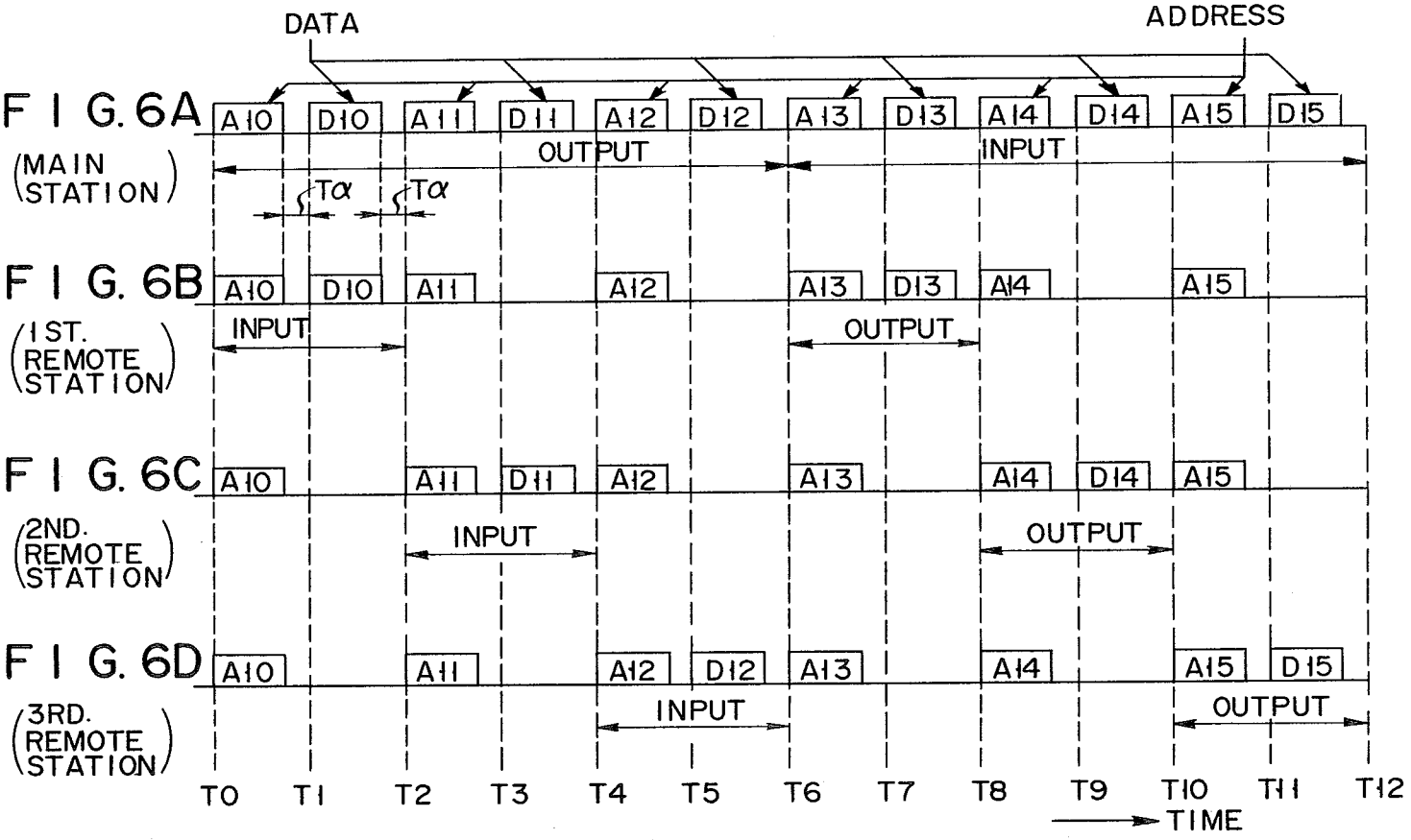
FIG. 6A (MAIN STATION)
FIG. 6B (1ST. REMOTE STATION)
FIG. 6C (2ND. REMOTE STATION)
FIG. 6D (3RD. REMOTE STATION)

GROUP CONTROL APPARATUS FOR ELEVATORS

BACKGROUND OF THE INVENTION

1. Field of the Invention

The present invention generally relates to a group control apparatus for elevators.

2. Discussion of Background

With the advent of microcomputers, apparatuses for controlling the raising and lowering of elevators, or controlling hall assignments for respective elevators, have undergone tremendous changes. Conventional elevator control apparatuses mostly use relay control circuits. When the number of kinds of the elevator control functions increases, the number of relays correspondingly increases. Such an increase hinders the drive for smaller weight, lower cost, and lower power consumption. However, these problems are solved through an elevator control apparatus utilizing a compact, high performance microcomputer. The use of a microcomputer not only solves the above problems but also assists design and development of group control apparatuses and, in result, versatile and flexible elevator control has become possible.

Microcomputers may be applied to both a single unit control apparatus, which controls a single elevator (single elevator cage), and a group control apparatus, which totally controls a plurality of elevators (several elevator cages). As is well known, a group control apparatus functions to provide higher operational efficiency and better service to passangers or users when a plurality of elevator cages operate in a single system. More specifically, a group control apparatus has a hall assignment control function. With this function, in response to a hall call from the elevator hall on a certain floor, the microcomputer immediately selects an elevator cage for optimal service, so that the selected elevator cage quickly responds to the hall call. The group control apparatus also has an emergency operation control function in case of fires or earthquakes, and a rush-hour control function for providing optimal service during rush-hour. With the rush-hour control function, for example, the number of journeys of each elevator cage is increased within a specific time range.

In an elevator system using a conventional group control apparatus, when a hall call is generated upon depression of the hall button of a specific floor by a user, the hall call is registered in a hall call registration unit. The hall call registration unit supplies the hall call to the group control apparatus. The microcomputer in the group control apparatus selects an elevator which can reach the called floor in the shortest time, in accordance with the present cage positions of the respective elevators, with the cage call registration state, with the operation state of elevators and the like. The group control apparatus then registers the hall call in the single unit control apparatus for the selected elevator. Upon this hall call registration, the single unit control apparatus causes the corresponding elevator cage to go to the floor from which the hall call has been generated.

However, with such a conventional system, when the hall call registration unit fails so that a required hall call registration and data transmission are prevented, a hall call signal from the hall-called floor cannot be transmitted to the group control apparatus, and group control is thus disabled.

In this respect, the hall call registration unit is a determining factor in the reliability of conventional systems. In other words, a failure of the hall call registration unit results in breakdown of the overall group control system.

An example of such a conventional system is disclosed, e.g., in U.S. Pat. No. 3,851,735 (Winkler et al.) issued on Dec. 3, 1974. The contents disclosed in this U.S. Patent are incorporated in this application.

A microcomputer in an elevator group control apparatus requires a number of input/output signal lines. This is because the elevator control apparatus must process several hundreds of signals, including those from a position indicator, a hall registration unit, a lantern chime, and so on, mounted at each floor, and those from a cage call registration unit, a position indicator, an operation mode switch and so on, mounted in each elevator cage.

Since parallel signal transmission is adapted in a conventional elevator control apparatus, all signal lines provided for respective transmitted signals are directly connected to the I/O ports of the microcomputer. From this, in order to allow signal transmission between the microcomputer and each device on each floor, the amount of wiring in the elevator path is enormous. This has created problems of the large amount of space and costly installation operation required for wiring ducts. As for signal transmission between the microcomputer and each device in each cage, the number of tail chords (signal cables) required is also large. With the recent trend toward taller buildings, this has presented problems of complex elevator installation and maintenance operations.

SUMMARY OF THE INVENTION

It is accordingly the primary object of the present invention to provide a group control apparatus for elevators, which can reduce the number of signal lines required for signal transmission between the group control apparatus and floor halls or elevator cages, and which permits easy installation and maintenance operations.

It is the secondary object of the present invention to provide a group control apparatus for elevators, in which the hall call processing function is dispersed, so that a failure in one part of the group control system does not result in system breakdown, and which provides highly reliable group control.

The primary object of the present invention can be achieved by connecting a main station of the elevator control apparatus, mounted at the elevator control room or the like, with remote stations at respective floors or cages, via a single signal line (bus) through which serial signal (data) transmission is performed.

The secondary object of the present invention can be achieved by setting the number of main stations, which are connected to the respective remote stations through a single signal line, to 2 or more, and allowing only one (master) of the plural main stations to perform a hall call registration or group control of elevators based on the data obtained from the respective remote stations. In this case, the same data supplied to the master main station, performing the hall call registration, is also supplied to other main station(s) (slave), not performing such a hall call registration. If the master main station fails, the slave main station can continue the hall call registration and its associated operations.

BRIEF DESCRIPTION OF THE DRAWINGS

FIGS. 6A through 6D are timing charts for explaining serial data communication of FIG. 5A;

DETAILED DESCRIPTION OF THE PREFERRED EMBODIMENTS

Figure 1:
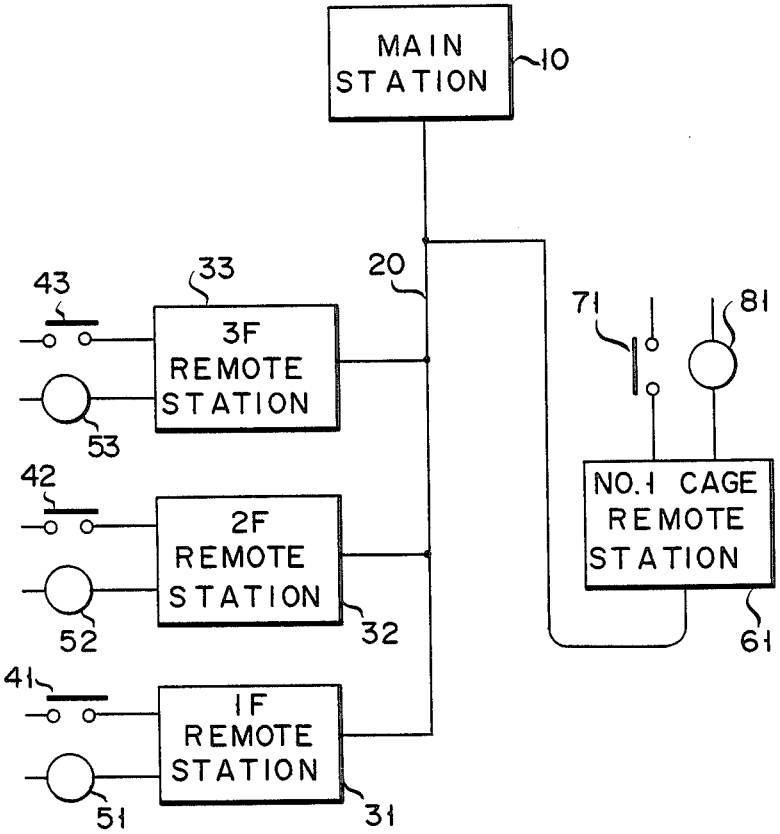
FIG. 1 is a block diagram showing a group control apparatus for elevators according to an embodiment of the present invention, in which a plurality of remote stations 31 to 33 and single main station 10 perform data communication via single serial data transmission bus 20.

FIG. 1 shows a group control apparatus according to an embodiment of the present invention. 1F (i.e. First Floor) remote station 31 is arranged in the elevator hall on the first floor (1F) of a building (not shown). Hall call button 41, which is provided for calling an elevator cage (not shown) to the first floor, and hall call registration indicator 51, which is turned on upon registration of the hall call by button 41 in main station 10, are connected to station 31. Button 41 and indicator 51 are mounted on the wall surface near the elevator entrance (not shown).

Remote stations 32 and 33 are similarly mounted on the second and third floors (2F and 3F) of the building.

Remote stations 31 to 33 of the 1F to 3F are coupled, via single serial data transmission bus 20, to main station 10 so as to control or govern the operation of the elevator cages, etc. Bus 20 can consist of a pair of signal lines, or it may be one or more of optical fiber(s). (If remote stations 31 to 33 and main station 10 respectively have FM transmitters/receivers and their associated devices, physical cable bus 20 can be removed. Even if physical cable bus 20 is removed, when FM transmitters/receivers or the like are adapted, a single bus, coupling main station 10 and remote stations 31 to 33, still functionally exists. Thus, a wireless bus can also be considered as a single serial data transmission bus (20) in the present invention.)

Figure 3:
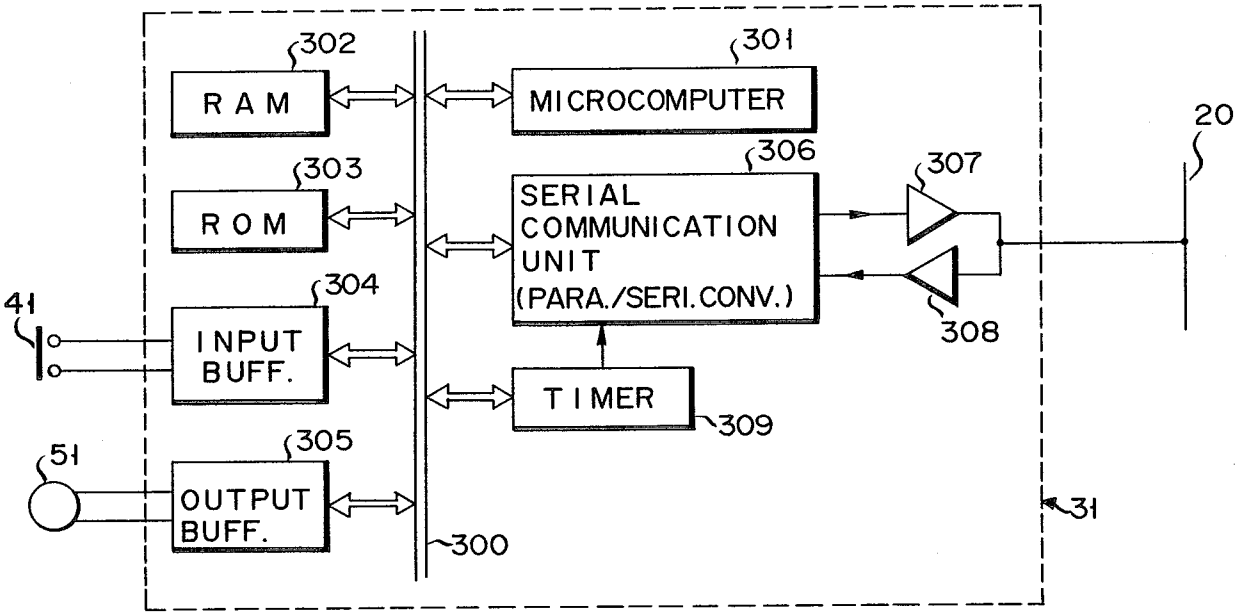
FIG. 3 is a block diagram showing the internal configuration of one (31) of the floor remote stations (31–33) shown in FIGS. 1 and 2 (this configuration can also be the same as for cage remote station 61 in FIG. 1)

1F remote station 31 may have a configuration as shown in FIG. 3. When hall call button 41 is depressed, hall call information is supplied to microcomputer 301 through input buffer 304 and data bus 300. In accordance with a program (to be described with reference to FIG. 8) stored in ROM 303, microcomputer 301 sends the hall call information (parallel data) to serial communication unit (parallel/serial converter) 306. Unit 306 supplies the hall call information (serial data) onto bus 20 through bus driver 307, at a data transmission rate corresponding to the clock frequency of timer 309.

Figure 4:
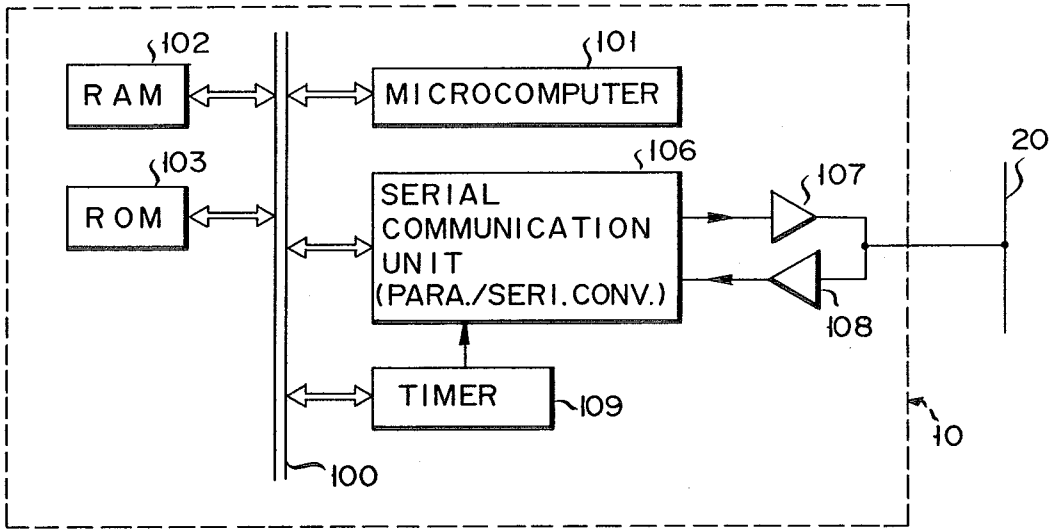
FIG. 4 is a block diagram showing the internal configuration of main station 10 in FIG. 1 (this configuration can also be the same as for main stations 11 to 13 in FIG. 2)

FIG. 4 shows an example of a configuration of main station 10. When 1F hall call information (serial data) from 1F remote station 31 (FIG. 3) is transmitted onto bus 20, it is supplied to serial communication unit 106 through bus receiver 108. Unit 106 converts the hall call information into parallel data in response to the clocks of timer 109. The parallel hall call information is supplied, through bus 100, to microcomputer 101 of main station 10. Then, a 1F hall call is stored (registered) in RAM 102.

In accordance with a predetermined program sequence (to be described with reference to FIG. 7B) stored in ROM 103, microcomputer 101 sends hall call registration information (parallel data) to serial communication unit 106. Unit 106 converts the received parallel data into serial hall call registration information and transmits it onto bus 20 through bus driver 107.

When the hall call registration information is sent onto bus 20, it is supplied to serial communication unit 306 through bus receiver 308 in FIG. 3. Unit 306 converts serial hall call registration information into parallel data and supplies it to microcomputer 301. Microcomputer 301 supplies data, indicating that hall call registration has been performed, to RAM 302 and to output buffer 305. Then, the hall call registration for 1F is completed and indicator 51 is turned on.

In the embodiment of FIG. 1, cage remote station 61 is coupled to main station 10 through bus 20. The internal configuration of cage remote station 61 can be the same as that shown in FIG. 3. Cage call button 71 and cage call registration indicator 81, for cage remote station 61, have the same functions as hall call button 41 and hall call registration indicator 51, for first floor remote station 31. Station 61 is mounted in elevator cage No. 1 (not shown).

In the embodiment shown in FIG. 1, master main station 10, having an ability to govern bus 20, accesses not only floor remote stations 31 to 33, but also cage remote station 61.

2F and 3F remote stations 32 and 33, in FIG. 1, can have the same configuration as 1F remote station 31.

Incidentally, a plurality of stations 10 and 31 to 33 are multi-drop connected to single bus 20 and, therefore, bus drivers 107 and 307 and bus receivers 108 and 308 preferably comply with the "RS485" ISO communications standard. When drivers/receivers which comply with this standard are used, data transmission at a baud rate of 100 kbps (bit/sec) can be performed even when bus 20 is two to three hundred meters long.

Serial communication units 106 and 306 can be comprised of, for example, LSI model "i8251" delivered of Intel Co., Ltd., in USA, which is called a Universal Asynchronous Receiver Transmitter (UART).

Figure 2:
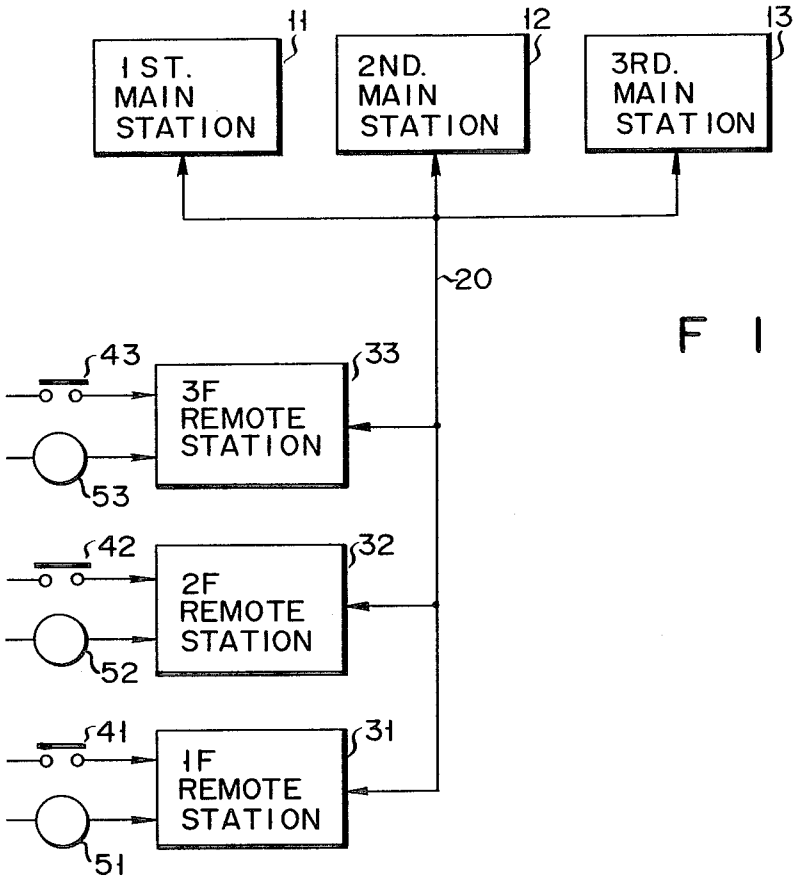
FIG. 2 is a block diagram showing a group control apparatus for elevators according to another embodiment of the present invention, in which a plurality of floor remote stations 31 to 33 and any one of plural main stations 11 to 13 perform data communication via single serial data transmission bus 20.

FIG. 2 shows another embodiment of the present invention, wherein main station 10, in FIG. 1, is replaced with a plurality of main stations 11 to 13. (The number of stations 11 to 13 can be different from the number of stations 31 to 33 or the number of elevator cages.)

The internal circuit configuration of main stations 11 to 13 can be as shown in FIG. 4. In the embodiment shown in FIG. 2, not all of main stations 11 to 13 similarly access remote stations 31 to 33, but only normal one among main stations 11 to 13 accesses remote stations 31 to 33, while the remaining main stations serve as backup main stations. For example, when all main stations 11 to 13 are normal, only station 11 sends address signals for data transmission onto bus 20 and accesses stations 31 to 33. In this case, stations 12 and 13 merely fetch data (the data supplied to station 11) on bus 20, but they do not send address signals to bus 20. However, if station 11 fails and does not send address signals more than a predetermined period of time, station 12 acts in place of station 11 and sends address signals for data transmission onto bus 20. In this manner, when station 11 fails, station 12 accesses stations 31 to 33. Similarly, when both stations 11 and 12 fail, station 13 accesses stations 31 to 33.

In the embodiment of FIG. 2, main stations 11 to 13 access remote stations 31 to 33 in accordance with a predetermined priority order. A single main station is assigned the right or ability to access remote stations (or to govern bus 20), and the remaining main stations serve as backup slave main stations.

The manner of access of the master station (one of stations 10 to 13) to remote stations 31 to 33 (and 61) may be common for the embodiments of FIGS. 1 and 2. A description will now be made with reference to FIGS. 5 to 8, for a case wherein first main station 11 serves as a main station to access 1F to 3F remote stations 31 to 33, in FIG. 2.

Figures 5A, 5B:
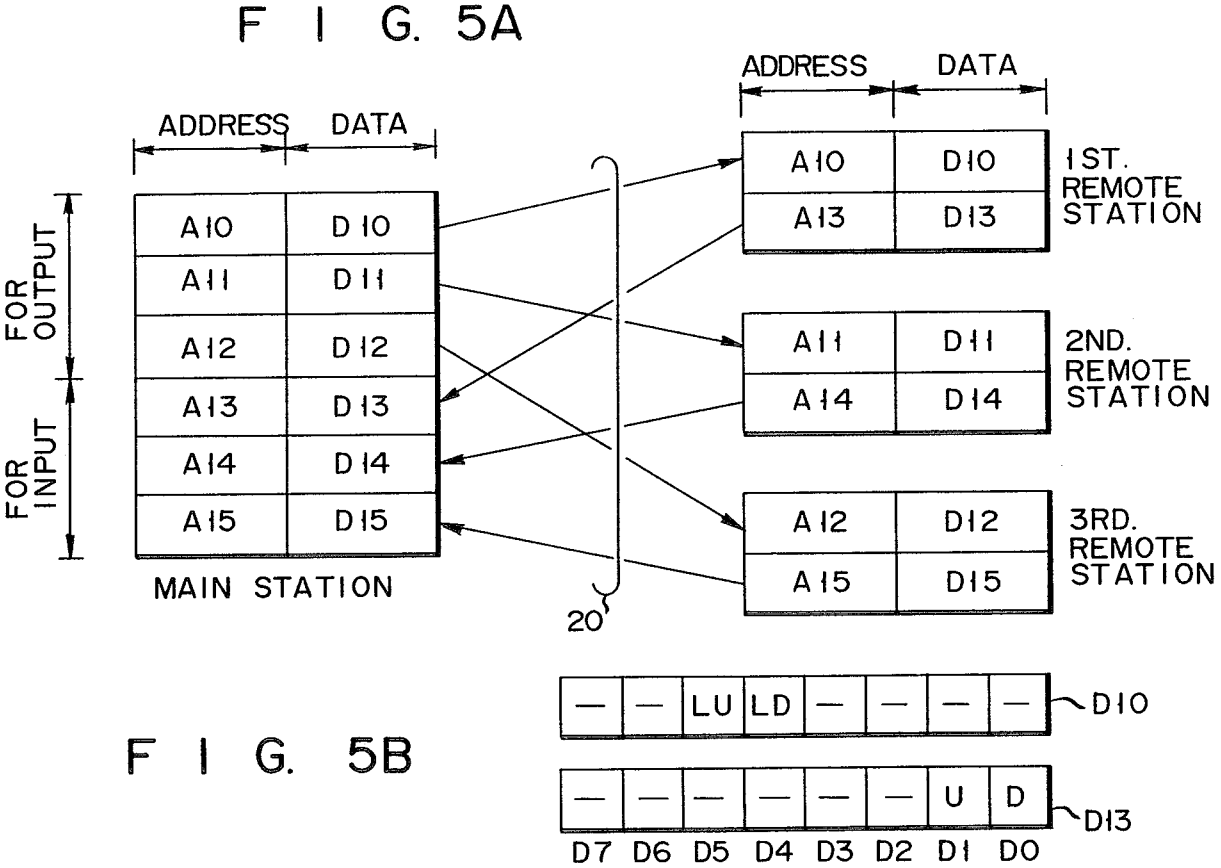
FIG. 5A shows an address map of data exchanged between one of main stations 11 to 13 and remote stations 31 to 33 in FIGS. 1 and 2, through serial data transmission bus 20.
FIG. 5B shows an example of a data format of data D10 and D13 exchanged by remote station 31.

FIG. 5A shows an address map. Master main station 11 uses 6 addresses A10 to A15 so as to assign pairs (e.g., D10 and D13) of output data (D10 to D12) and input data (D13 to D15) to respective remote stations 31 to 33. For example, address A10 is used to supply output data D10, in FIG. 5B, to remote station 31. When main station 11 outputs address A10 and then data D10, remote station 31 fetches sent data D10 in accordance with address A10. Address A13 is used to allow remote station 31 to generate data D13, in FIG. 5B. When main station 11 outputs address A13, remote station 31 outputs data D13, corresponding to data D10, onto bus 20, and main station 11 receives data D13.

Symbol D, represented by bit D0 of data D13 in FIG. 5B, goes to "1" when 1F "down" switch 41 is turned on. Symbol U, represented by bit D1, goes to "1" when 1F "up" switch 41 is turned on. LD, represented by bit D4 of data D10, goes to "1" in response to D0 = "1" of data D13 so as to turn on down hall call registration indicator 51. LU, represented by bit D5, goes to "1" in response to D1 = "1" of data D13 so as to turn on up hall call registration indicator 51. Data D11 and D14, as well as data D12 and D15, shown in FIG. 5A, have the same format as that shown in FIG. 5B.

In this manner, addresses A10 to A15 determine which remote station is to receive/transmit data and what processing is to be performed. Control data (D10 to D12) for the hall call registration indicator is sent from the main station to the selected remote station, and hall call information (D13 to D15) is sent from the remote station station to the main station.

The data transmission sequence and data input/output timings at each station will be described with reference to FIGS. 6A to 6D. The data transmission sequence is stored in ROM 103 and ROM 303 of the main and remote stations in the form of a program, and is executed by corresponding microcomputer 101 or 301.

At time T0, master main station 11 outputs address signal A10 onto bus 20. In response to signal A10, remote stations 31 to 33 check if signal A10 corresponds to their own addresses, as defined in FIG. 5A. If signal A10 corresponds to its own address, the remote station (31) immediately checks if the address is for input or output. If the address is for input, the remote station (31) receives data D10 on bus 20 at time T1. More specifically, remote station 31, which has received signal A10, determines that signal A10 is for its own address and is for input, and therefore awaits data D10. Meanwhile, after outputting address signal A10, main station 11 immediately checks if signal A10 is for input or output to itself. Since address signal A10 is designated as output for main station 11, it outputs data D10, stored at address A10, onto bus 20 at time T1.

When the above processing is continued to address A15 (time T12), or to the end of one cyclic scan, one data transmission cycle for remote stations 31 to 33 has been completed. Thus, the contents on bus 20 along the time axis become as shown in FIG. 6A. One cyclic scanning period T of six data D10 to D15 is given by:

$$T = T1 + T2 + \ldots T12 + T\alpha \times 12$$

where $T\alpha$ is the processing time required for each station to determine if the data transmission, as described above, is provided for its own, and to determine, in this case, if the transmission is for input or output.

In the above description, data to be processed by a remote station is one input or one output data item. However, in the case of cage remote stations, two or more data may have to be processed. This can be easily performed by increasing the memory space (address number) in each of main stations 11 to 13.

Figure 7A:
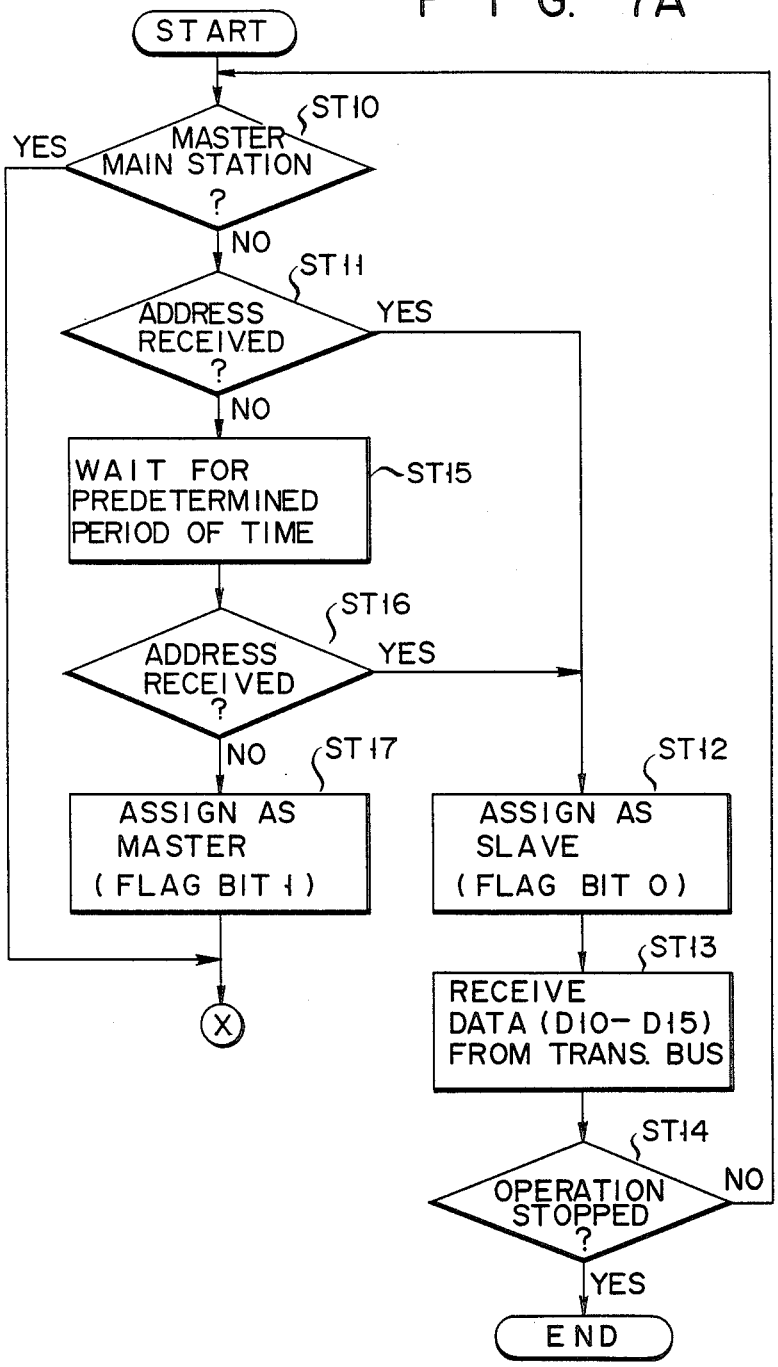
FIG. 7A is a flow chart of a sequence for assigning one of main stations 11 to 13 as master and others as slave station in FIG. 2.
Figure 7B:
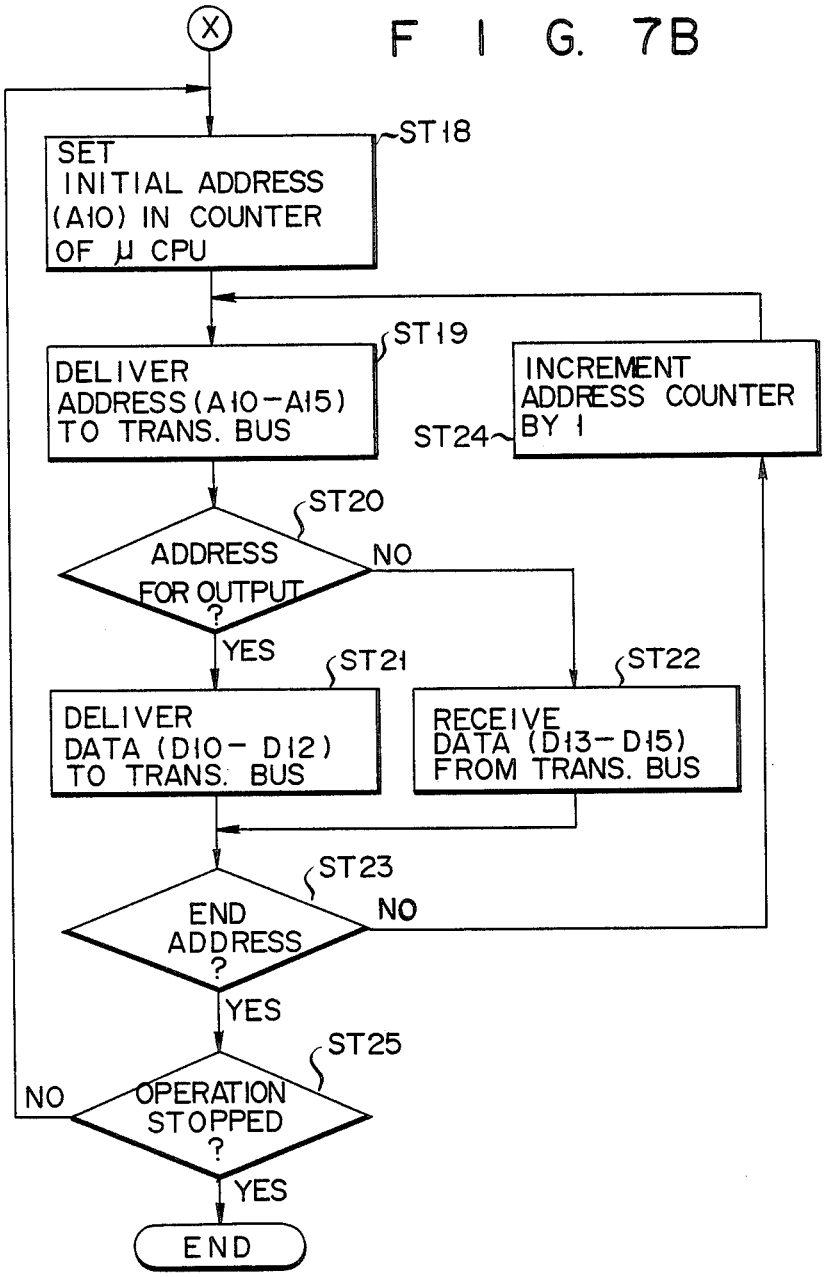
FIG. 7B is a flow chart of a data communication sequence (cyclic scan) of a master main station (10–13) in FIG. 1 or 2.
Figure 8:
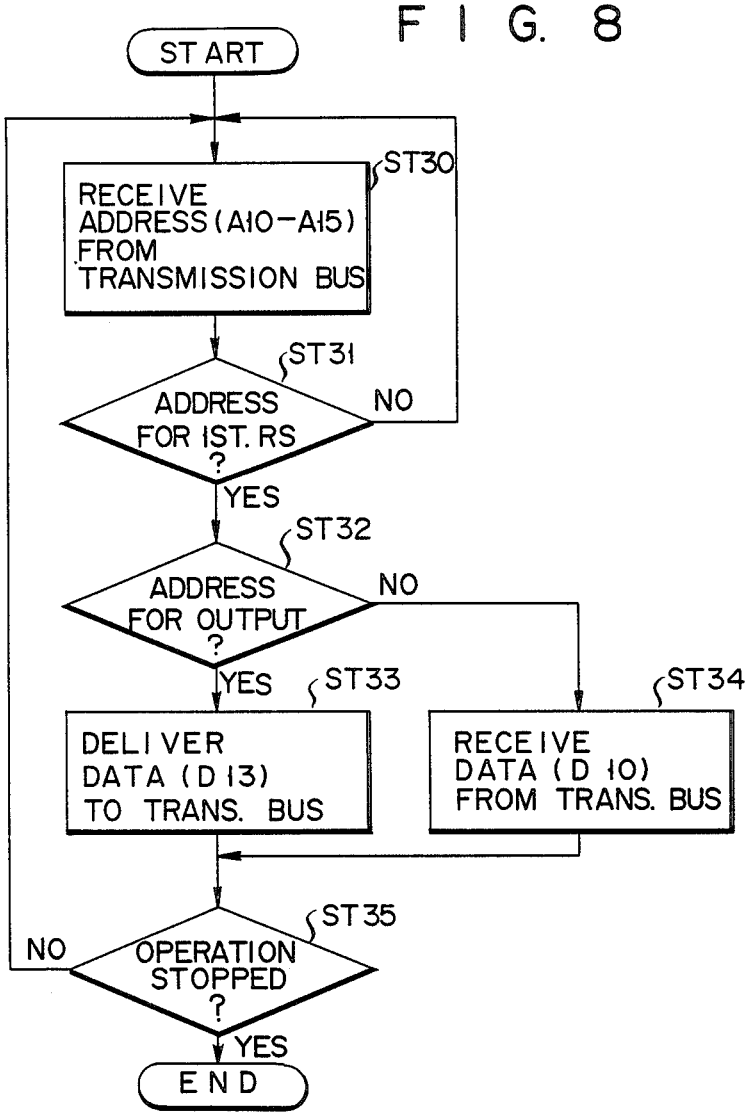
FIG. 8 is a flow chart of a data communication sequence (cyclic scan) of remote stations (31 to 33 or 61) in FIG. 1 or 2.

The above processing sequence of main station 11 can be illustrated by the flow charts in FIGS. 7A and 7B, and the processing sequence of remote stations 31 to 33 can be illustrated by the flow chart in FIG. 8.

Microcomputers of main stations 11 to 13 have flag bits (not shown) which indicate if they are a master station. When main stations 11 to 13 are powered, the flag bit of station 11 goes to "1" while the flag bits of stations 12 and 13 go to "0" in the initialization routine. Then, station 11 serves as a master main station (FIG. 7A, ST10, YES).

At main station 11, initial address A10 is set in an address counter (not shown) of microcomputer 101 in FIG. 4 (ST18 in FIG. 7B). In ST19, set address A10 is sent onto bus 20. In ST20, it is checked whether address A10 is assigned to station 11 as output. If YES in ST20, a corresponding item of output data D10 to D12 is output onto bus 20 in ST21. However, if NO in ST20, a corresponding item of input data D13 to D15 is received and fetched into station 11 from bus 20 in ST22. In ST23, it is checked whether the present address is the end address. In this embodiment, since 6 addresses are used, it is checked whether processing up to address A15 has been completed, by checking the count of the address counter (not shown).

When it is determined in ST23 that the address signal is the end address (YES) and the processing is in progress (ST25, NO), the flow returns to ST18. However, if the address signal has not reached the end address (ST23, NO), the flow advances to ST24. In ST24, the count of the address counter (not shown) is incremented by one. In ST19, address All, corresponding to the incremented count of the address counter, is output onto bus 20.

The above steps ST18 to ST25 are repeated. When YES in ST23, the flow returns to designation of address A10 (ST18) and the same sequence is repeated (this is called cyclic scan).

Station 11 operates according to the flow of FIG. 7B, as long as station 11 is operating normally as a master main station. In this case, operations of stations 12 and 13, serving as slave main stations, are as indicated in ST10 to ST14 in FIG. 7A.

Each slave main station (e.g., 12) receives an address signal (A10–A15) from bus 20 (ST11, YES). Since station 12 is not a master station, it is determined to be a slave station (ST12) and receives data (D10–D15) corresponding to the address signal (A10–A15) from bus 20 (ST13). If the control apparatus shown in FIG. 2 is in operation (ST14, NO), station 12 receives an address signal (A10–A15) (ST11, YES) sent from station 11 and following data (D10–D15) such as hall call information (ST13). Thereafter, slave station 12 (and 13) repeats ST10 to ST14 (cyclic scan).

When master main station 11 fails and no more address signals (A10–A15) are sent to bus 20 (ST11, NO), station 12 (and 13) still awaits an address signal from bus 20 for a predetermined period of time (e.g., 2.5 sec for station 11, 5.0 sec for station 12, and 7.5 sec for station 13) (ST15). When no address signal (A10–A15) appears on bus 20 after passing 5 seconds from the change of ST11 to ST15 (ST16, NO), the flag bit of station 12 changes from "0" to "1" (ST17). Then, station 12 becomes a master main station and executes the flow in FIG. 7B.

When both stations 11 and 12 fail and no address signal (A10–A15) is sent onto bus 20 (ST11, NO), station 13 awaits input of an address signal for 7.5 sec (ST15). When no address signal (A10–A15) is sent onto bus 20 for 7.5 sec after the control flow shifts from ST11 to ST15 (ST16, NO), the flag bit of station 13 is changed from "0" to "1" (ST17). Thereafter, station 13 serves as a master main station and executes the flow in FIG. 7B.

In each of remote stations 31 to 33, as shown in FIG. 8, an address signal (A10–A15), sent from bus 20, is received and fetched in ST30. Then, it is checked whether the fetched address signal indicates its own station (e.g., first remote station 31) in ST31. If NO in ST31, the flow returns to ST30. However, if YES in ST31, it is checked in ST32 whether the address signal indicates output. If YES in ST32, corresponding output data (e.g., D13) is output onto bus 20 in ST33. When it is not "operation stop" (ST35, NO), the flow returns to ST30. If NO in ST32, data (e.g., D10) is received and fetched from bus 20 in ST34. If it is not "operation stop" (ST35, NO), the flow returns to ST 30.

Each remote station (31–33) performs the above operation.

The memory map of master main station 11 has been described with reference to FIG. 5A. Other slave main stations 12 and 13 have the same memory space, i.e., 6 addresses. When master main station 11 normally governs bus 20, all 6 addresses in each of slave main stations 12 and 13 are for input (data reception). This is to allow slave main stations 12 and 13 to store, in their memories (RAM 102 FIG. 4), data D10 to D12 output from master main station 11 governing bus 20, and data (D13–D15) output by remote stations 31 to 33. Namely, slave main stations 12 and 13 store all data appearing on bus 20. Therefore, memories (RAMs 102) of slave main stations 12 and 13, currently not governing bus 20, constantly store updated data stored in the memory (RAM 102) of master main station 11 which is currently governing bus 20.

With the above arrangement, when master main station 11, currently governing bus 20, fails, one of remaining slave main stations 12 and 13 (e.g., 12) can continue to govern bus 20 with the same data as has been stored in station 11 immediately before it failed. New master main station 12, which gets the ability for governing bus 20, assigns the memory space (which has been assigned to input only before the failure of station 11) such that addresses A10 to A12 are for output while addresses A13 to A15 are for input.

Detection of a failure of the master main station will now be described.

The state of bus 20 is normally as shown in FIG. 6A. That is, addresses (A10–A15) and data (D10–D15) are alternately, but without interruption, transmitted onto bus 20 according to the bus governing function of the master main station. When the master main station, currently governing bus 20, fails, no address (A10–A15) is generated. When any address (A10–A15) is not generated, no data (D10–D15) is input or output (transmitted or received). Therefore, bus 20 is kept in a state wherein no data (A10–A15, D10–D15) is present thereon.

Meanwhile, another slave main station (e.g., 12) has the same memory space as that of failed master main station 11 and can periodically (e.g., each 0.1 sec) access all addresses (A10–A15) (ST11 in FIG. 7A). When such access is not achieved over a predetermined detection time (e.g., 5 sec) (ST16, NO in FIG. 7A), slave main station 12 determines that current master main station 11 has failed, and it becomes a master (ST17 in FIG. 7A), to start the governing of bus 20 (ST18–ST25 in FIG. 7B). In order not to allow more than one slave main station (12, 13) to start as a master simultaneously, a different detection time (wait time in ST15 in FIG. 7A) must be set for each main station in accordance with the priority order.

This priority order is predetermined in advance, in the following manner. Main stations 11 to 13 have the internal configuration as shown in FIG. 4. Even if none of address signals A10 to A15 is input from bus 20 for over 0.1 sec, station 11 awaits, as a slave station, input of an address signal until 2.5 sec passes, by means of timer 109 (ST15 in FIG. 7A). Similarly, station 12 awaits input of an address signal for 5 sec, and station 13 awaits input of an address signal for 7.5 sec.

When all of main stations 11 to 13 are normal and 2.5 sec after no address signal is detected (this could happen immediately after the control apparatus is powered), station 11 becomes a master (ST17 in FIG. 7A). 0.1 sec after it has become a master, station 11 sends an address signal (A10–A15) onto bus 20. Since this address appears on bus 20 within the wait time (5 sec for station 12 and 7.5 sec for station 13) of station 12 or 13, stations 12 and 13 become slave stations (ST12 in FIG. 7A).

When master main station 11 fails and does not send an address signal (A10–A15) for over 5 sec onto bus 20, slave main station 12 becomes a master (ST17 in FIG. 7A) in response to absence of an address signal (ST16, NO in FIG. 7A). 0.1 sec after it has become a master station, station 12 sends an address signal (A10–A15) onto bus 20. Since this address appears on bus 20 within the wait time (7.5 sec in ST15 in FIG. 7A) of station 13, station 13 becomes a slave station (ST12 in FIG. 7A).

Similarly, when both main stations 11 and 12 fail and no address signal (A10–A15) appears on bus 20 for more than 7.5 sec (ST16, NO in FIG. 7A), slave main station 13 becomes a master main station (ST17). In this manner, the priority for assigning main stations as a master is determined by the signal wait times (e.g., 2.5, 5.0, and 7.5 sec) in ST15 in FIG. 7A.

In this manner, when the master main station which has been governing bus 20 fails, another slave main station which detects this failure first, obtains the bus governing ability so as to allow normal, continuous data transmission with respective remote stations.

In this apparatus, a main station (one of main stations 10 to 13) has the function of a single unit control apparatus for controlling each elevator, and remote stations 31 to 33 are mounted at the elevator halls of respective floors. Remote stations 31 to 33 supply outputs from hall call buttons 41 to 43, as data D13 to D15, to main stations 10 to 13, and receive hall call registration indicator ON command from a main station (one of main stations 10 to 13). The master main station (e.g., 11), having the ability of governing the bus, among main stations 10 to 13, sequentially receives hall call information D13 to D15 from remote stations 31 to 33, through bus 20. Upon registering the received information, master main station 11 supplies hall call registration indicator ON commands D10 to D12, to turn on hall call registration indicators 51 to 53. Since other slave main stations 12 and 13 also hold this data, even when master main station 11 fails, another slave main station 12 having a higher priority can be immediately substituted for failed station 11, thereby allowing continuous data transmission with remote stations 31 to 33. In this manner, hall call registration control can continue without any problem.

With the group control apparatus for elevators according to the present invention, even if one or more main stations fail, the system can continue its normal function and system reliability is improved. Since a single serial data transmission bus is used as data transmission means, signal line installation labor and the costs thereof can be reduced as compared with a conventional system which uses a number of parallel signal lines for each elevator.

As has been described above, according to the apparatus of the present invention, remote stations for inputting/outputting data of hall call buttons and hall call registration indicators are controlled by microcomputers and arranged for respective floors. In addition, each single unit control apparatus also has a microcomputer so that it can serve as a main station. One main station is assigned the right or ability to act as the master main station. The selected master main station directly and serially supplies hall call information to the remote stations at respective floors. This information is directly and serially supplied to the main stations in the respective unit control apparatuses by a sequential (serial) bus scheme, so that each main station can constantly monitor the hall call state. Therefore, even if a master main station which is currently governing the bus fails, the bus governing ability can be immediately shifted to another main station without interruption in the previous hall call state. Therefore, even if the master main station fails, backup against any failure can be immediately provided without causing any trouble to users, thereby providing a highly reliable system. Since a serial data transmission system is adopted, the amount of wiring is small, and the wiring cost and time required thereto can be saved significantly.

While the invention has been described in connection with what is presently considered to be the most practical and preferred embodiment, it is understood that the invention is not to be limited to the disclosed embodiment but, on the contrary, is intended to cover various modifications and equivalent arrangements included within the spirit and scope of the appended claims which scope is to be accorded the broadest interpretation so as to encompass all such modifications and equivalent structures.

What is claimed is:

1. A group control apparatus for elevators, comprising:

a plurality of main stations each for performing a hall call registration of an elevator cage, one of said main stations serving as a master main station for governing the hall call registration of said elevator cage, another of said main stations serving as a slave main station which is supplied from said master main station, and an address signal being used for receiving hall call data indicating said hall call registration;

a plurality of floor remote stations arranged in elevator halls of respective floors in a building in which elevators are installed, for generating said hall call data which calls said elevator cage, and performing a call display of said elevator cage; and single data transmission means, for coupling each of said floor remote stations with each of said main stations, for performing serial data transmission of said hall call data between said floor remote stations and said main stations so that said hall call registration is effectted at each of said main stations, and for performing serial data transmission of said address signal between said master main station and said slave main station, wherein when said master main station fails to stop the supply of said address signal on said single data transmission means for a period more than a predetermined period of time, said slave main station detects the failure of said master main station based on the absence of said address signal on said single data transmission means, so that said slave main stations governs the hall call registration of said elevator cage in place of the failed master main station.

2. An apparatus according to claim 1, wherein said elevator cage includes:

cage remote station means, coupled to each of said main stations, for generating said hall call data designating the hall of any of said floors to which said elevator cage is to be shifted, and performing the call display of said floors.

3. An apparatus according to claim 2, wherein said cage remote station means serially transmits data representing a call of said elevator cage to said main stations means through said single data transmission means, and said main station means serially transmits data for the call display of said elevator cage to said cage remote station means through said single data transmission means.

4. An apparatus according to claim 2, wherein said floor remote stations and said cage remote station means, respectively, serially transmit data representing a call of said elevator cage to said main stations through said single data transmission means, and said main stations serially transmits dat for the call display of said elevator cage to said floor remote stations and said cage remote station means.

5. An apparatus according to claim 1, wherein said floor remote stations means serially transmits data representing a call of said elevator cage to said main stations means through said single data transmission means, and said main stations serially transmits data for the call display of said elevator cage to said floor remote stations means through said single data transmission means.

6. A group control apparatus for elevators in a system wherein a plurality of elevators are used for a plurality of floors, and main stations for controlling the operation of said elevators are coupled to said elevators, said group control apparatus selecting a suitable elevator cage in response to a hall call generated at a hall of a given floor, and performing group control of said elevators, wherein a hall call button or generating said hall call, a hall call registration indicator for indicating a hall call registration, and a remote station are provided for each said hall, wherein each of said remote stations outputs hall call button data in response to specific address data, fetches hall call registration data in response to other specific address data delivered from one of said main stations, and on/off controls said hall call registration indicator in accordance with said hall call registration data, wherein each of said remote stations and each of said main stations are coupled through a single serial transmission bus, wherein one of said main stations controls each of said remote stations through said bus, and remaining said main stations store said hall call button data and said hall call registration data which are the same as those being stored in said one main station, wherein said one main station, controlling said remote stations, sequentially outputs said specific address data for receiving said hall call button data from each said remote station, performs hall call registration control, and outputs said other specific address data and said hall call registration data for each hall in accordance with the received hall call button data, and wherein, when said one main station controlling each of said remote stations fails, one of remaining said main stations controls said remote stations in place of the failed main station.

7. A group control apparatus for elevators in a system wherein a plurality of elevators are used for a plurality of floors, and main stations for controlling the operation of said elevators are coupled to said elevators, said group control apparatus selecting a suitable elevator cage in response to a hall call generated at a hall of a given floor, and performing group control of said elevators, wherein a hall call button for generating said hall call, a hall call registration indicator for indicating a hall call registration, and a remote station are provided for each said hall, wherein each of said remote stations outputs hall call button data in response to specific address data in response to other specific address data delivered from one of said main stations, and on/off controls said hall call registration data, wherein each of said remote stations and each of said main stations are coupled through a single serial transmission bus, and wherein one of said main stations controls each of said remote stations through said bus, and remaining said main stations store said hall call button data and said hall call registration data which are the same as those being stored in said one main station.

8. An apparats of claim 7, wherein said one main station, controlling said remote stations, sequentially outputs said specific address data for receiving said hall call button data from each said remote station, performs hall call registration contorl, and outputs said other specific address data and said hall call registration data for each hall in accordance with the received hall call button data.

9. An apparatus of claim 7, wherein when said one main station controlling each of said remote stations fails, one of the remaining said main stations controls said remote stations in place of the failed main station.

10. A group control apparatus for elevators in a system wherein a plurality of elevators are used for a plurality of floors, and main stations for controlling the operation of said elevators are coupled to said elevators, said group control apparatus selecting a suitable elevator cage in response to a hall call generated at a hall of a given floor, and performing group control of said elevators, wherein a hall call button for generating said hall call, a hall call registration indicator for indicating a hall call registration, and a remote section are provided for each said hall, wherein each of said remote stations outputs hall call button data in response to specific address data in response to other specific address data delivered from one of said main stations, and on/off controls and hall call registration indicator in accordance with said hall call registration data, wherein each of said remote stations and each of said main stations are coupled through a single serial transmission bus, and wherein said one main station, controlling said remote stations, sequentially outputs said specific address data for receiving said hall call button data from each said remote station, performs hall call registration control, and outputs said other specific address data for each hall in accordance with the received hall call button data.

11. An apparatus of claim 10, wherein said one main station controlling each of said remote stations fails, one of remaining said main stations controls said remote stations in place of the failed main station.

12. A group control apparatus for elevators in a system wherein a plurality of elevators are used for a plurality of floors, and main stations for controlling the operation of said elevators are coupled to said elevators, said group control apparatus selecting a suitable elevator cage is response to a hall call generated at a hall of a given floor, and performing group control of said elevators, wherein a hall call button for generating said hall call, a hall call registration indicator for indicating a hall call registration, and a remote station are provided for each said hall, wherein each of said remote stations outputs hall call cutton data in response to specific address data, fetches hall call registration data in response to other specific address data delivered from one of said main stations, and on/off controls said hall call registration data, wherein each of said remote stations and each of said main stations are coupled through a single serial transmission bus, and wherein, when said one main station controlling each of said remote stations fails, one of remaining said main stations controls said remote stations in place of the failed main station.

* * * * *